United States Patent [19]

Shimoda et al.

[11] Patent Number: 4,693,459

[45] Date of Patent: Sep. 15, 1987

[54] SHEET FEEDING SYSTEM IN RECORDING APPARATUS

[75] Inventors: Kazuho Shimoda; Shunichi Abe, both of Hachioji, Japan

[73] Assignee: Konishiroku Photo Industry Co., Ltd., Tokyo, Japan

[21] Appl. No.: 814,289

[22] Filed: Dec. 24, 1985

Related U.S. Application Data

[63] Continuation of Ser. No. 478,805, Mar. 25, 1983, abandoned, which is a continuation of Ser. No. 210,137, Nov. 24, 1980, abandoned.

[30] Foreign Application Priority Data

Nov. 26, 1979 [JP] Japan ..... 54-151992

[51] Int. Cl.[4] ..... B65H 3/44

[52] U.S. Cl. ..... 271/9; 271/164; 355/3 SH; 355/14 SH

[58] Field of Search ..... 271/9, 164; 355/3 SH, 355/14 SH

[56] References Cited

U.S. PATENT DOCUMENTS

| | | | |
|---|---|---|---|
| 3,920,238 | 11/1975 | Kitajima et al. | 271/9 |
| 3,977,666 | 8/1976 | Suzuki et al. | 271/9 |
| 4,265,440 | 5/1981 | Shibazaki et al. | 271/9 |
| 4,372,673 | 2/1983 | Tomosada et al. | 355/14 R |

FOREIGN PATENT DOCUMENTS

| | | | |
|---|---|---|---|
| 52-25639 | 2/1977 | Japan | 271/9 |

*Primary Examiner*—Richard A. Schacher
*Attorney, Agent, or Firm*—Jordan B. Bierman

[57] ABSTRACT

A control apparatus for feeding recording paper to an electrophotographic copying machine from one or the other of a pair of cassettes permits not only selection of a desired cassette with the desired size paper, but if one cassette is replaced with a new one, perhaps containing a different size paper, the electrophotographic copying machine will automatically be fed from the replacement cassette irrespective of the position of the cassette selecting equipment.

5 Claims, 2 Drawing Figures

SHEET FEEDING SYSTEM IN RECORDING APPARATUS

This application is a continuation of application Ser. No. 478,805, filed Mar. 25, 1983, now abandoned, which was a continuation of application Ser. No. 210,137, filed Nov. 24, 1980, now abandoned.

BACKGROUND OF THE INVENTION

1. Field of the Invention

The present invention relates to the sheet feeding controlling system of general recording apparatus such as electrophotographic copying machines and printing apparatus.

2. Description of the Prior Art

An example of an electrophotographic copying machine will be given. For copying an original, the method wherein the cassette is loaded in the apparatus and a sheet of recording paper is fed from the cassette for each copying operation is now available, in addition to the method wherein recording paper is fed manually one by one. Such a cassette contains many recording sheets, and recently, this type of cassette system is employed in most of the electrophotographic copying machines. Generally, the recording papers of prescribed sizes such as B6, B5, B4, A5, A4 and A3 or such as 8"×13", 8½"×14", 10"×15", 11"×17" and 11"×8½" are used for copying and the cassettes of such various sizes to accept the recording sheets of various sizes are available. Some of the recent electrophotographic copying machines have the feature that several different sized cassettes are loaded therein and with the operation of a selection button, the recording sheet is fed from the desired cassette. In another type wherein no cassette is used, different sized recording sheets of more than two types are loaded at fixed locations therein, and with the operation of a selection button, the recording sheet of desired size is used.

Now, since it is not advisable, from the view point of the size of the apparatus and the price thereof, to load recording sheets of all sizes in such types of recording apparatus, it is conventional in the small sized machine used generally that 2 to 3 types of different recording sheets are contained in the cassette for example and loaded therein. Therefore, when the recording sheet of desired size coincides with any one size of several sizes of loaded sheets, a simple operation of recording sheet size selection button is enough, but when they do not coincide, it is necessary to change the cassette to a cassette containing recording sheets of the desired size prior to the copying operation, and to operate the recording sheet size selection button so that the recording sheet can be fed from said changed cassette. In such cases, though it may be unavoidable to change the cassette, it is troublesome to operate the selection button further, and if such selecting operation is neglected carelessly, there is the danger that the recording may be done on the recording sheet the size of which is selected by the previous operator, and thus the copied material will not be useful in spite of changing the cassette.

SUMMARY OF THE INVENTION

In view of the aforesaid points, the present invention provide that when the recording paper is changed, the recording can certainly be done with said changed recording sheet without the necessity of a selecting operation for the type recording sheet, namely, it provides that the replacing of a recording sheet is detected and when the detection signal is led out, the sheet feeding device for the newly loaded recording sheets is operated in accordance with the copying operation to feed the sheets. As a concrete embodiment, the arrangement wherein cassettes having different sized recording papers respectively are loaded at an appropriate position in the recording apparatus, and a sheet feeding device is provided for each size of recording sheets, replacement of the cassettes is detected by a microswitch and by a detection signal, the sheet feeding device for the recording sheets contained in the newly loaded cassette is operated in accordance therewith.

DESCRIPTION OF THE PREFERRED EMBODIMENTS

An example of the present invention will be explained as follows with the aid of attached drawings.

Figure 1:
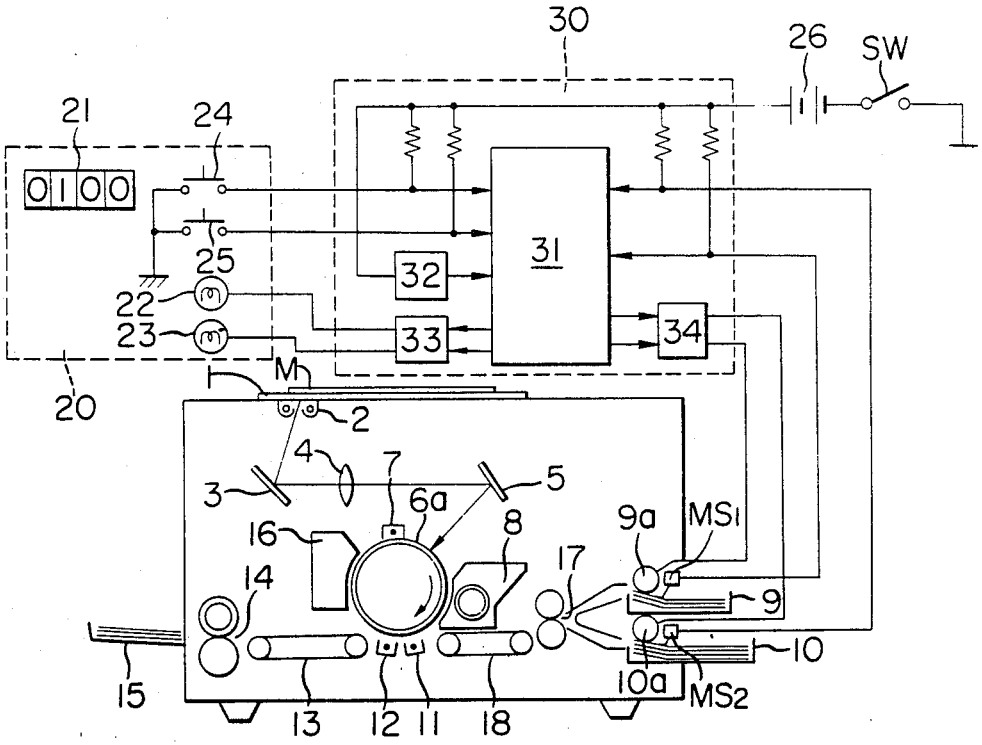
FIG. 1 of attached drawings is a diagrammatic illustration of a electrophotographic copying machine wherein the sheet feeding controlling system of the present invention is applied.

FIG. 1 shows an example wherein the present invention is applied to the electrophotographic copying machine of ordinary construction. In said copying machine, an original M placed on the copy board 1 is illuminated by the illuminating lamp 2 and the reflected light is projected onto the photo-receptor surface *6a* of the revolving drum through an optical system comprising mirror 3, lens 4 and mirror 5. The photo-receptor surface *6a* is charged uniformly by the charging electrode 7 and with the projection of the reflected light from the original M, an electrostatic latent image is formed thereon. The electrostatic latent image is developed by the developing device 8 and is turned into a visible image which is transferred onto the recording sheet fed from the cassettes 9 or 10 by the transferring electrode 11. After transferring, the recording sheet is separated from the photo-receptor by the separation electrode 12 and is conveyed by the conveyance device 13 to the fixing device 14 where the image is fixed and then delivered to the sheet delivery tray 15. Toner remaining on the surface of the photo-receptor surface *6a* after the separation of the recording paper is removed by the cleaning device 16. Recording sheets of different sizes are contained in the cassettes 9 and 10 and such recording sheets are fed from the cassette 9 by the first sheet feeding roller *9a* contacting the extremely top sheet therein and from the cassette 10 by the first sheet feeding roller *10a* contacting the extremely top sheet therein, synchronously with the recording operation. The recording sheet fed out from the cassette 9 or 10 is transported to the transferring position by the conveyance device 18 being synchronized exactly with the recording operation by the second paper feeding roller 17. On the cassettes 9 and 10, the no-sheet microswitches MS1 and MS2 to detect that no sheet is contained in the cassette are provided respectively.

On the indication panel 20 arranged at the proper location of the copying machine, the counter 21 to indicate the set quantity and the copied quantity, the indication lamp 22 for the upper cassette (cassette 9) and the indication lamp 23 for the lower cassette (cassette 10), the print button 24 and the cassette changing button 25 are provided. Since the priority is given to the upper cassette in the cassette changing button 25, the lower cassette is selected with the first push of the cassette changing button 25 and then the upper cassette is selected with the next push of said button, namely, the circuit thereof is so composed that the upper cassette and the lower cassette are selected alternately. In the controlling circuit 30, on the other hand, the one-chip microcomputer 31 wherein the central processor unit (CPU), the memory (RAM and ROM) and the input-/output unit are formed on a single chip, the resetting circuit 32 to reset said microcomputer when the power switch SW of the copying machine is turned on, the power amplified 33 to light the cassette indication lamps 22 and 23 and the power amplifier 34 to supply electricity to each motor (not illustrated) to drive the first sheet feeding roller 9*a* and the second sheet feeding roller 10*a*, are included. A direct current power source 26 is connected to the controlling circuit of the copying machine. The output signals of the microswitches MS1 and MS2 for the cassettes 9 and 10 are supplied to the microcomputer 31.

Figure 2:
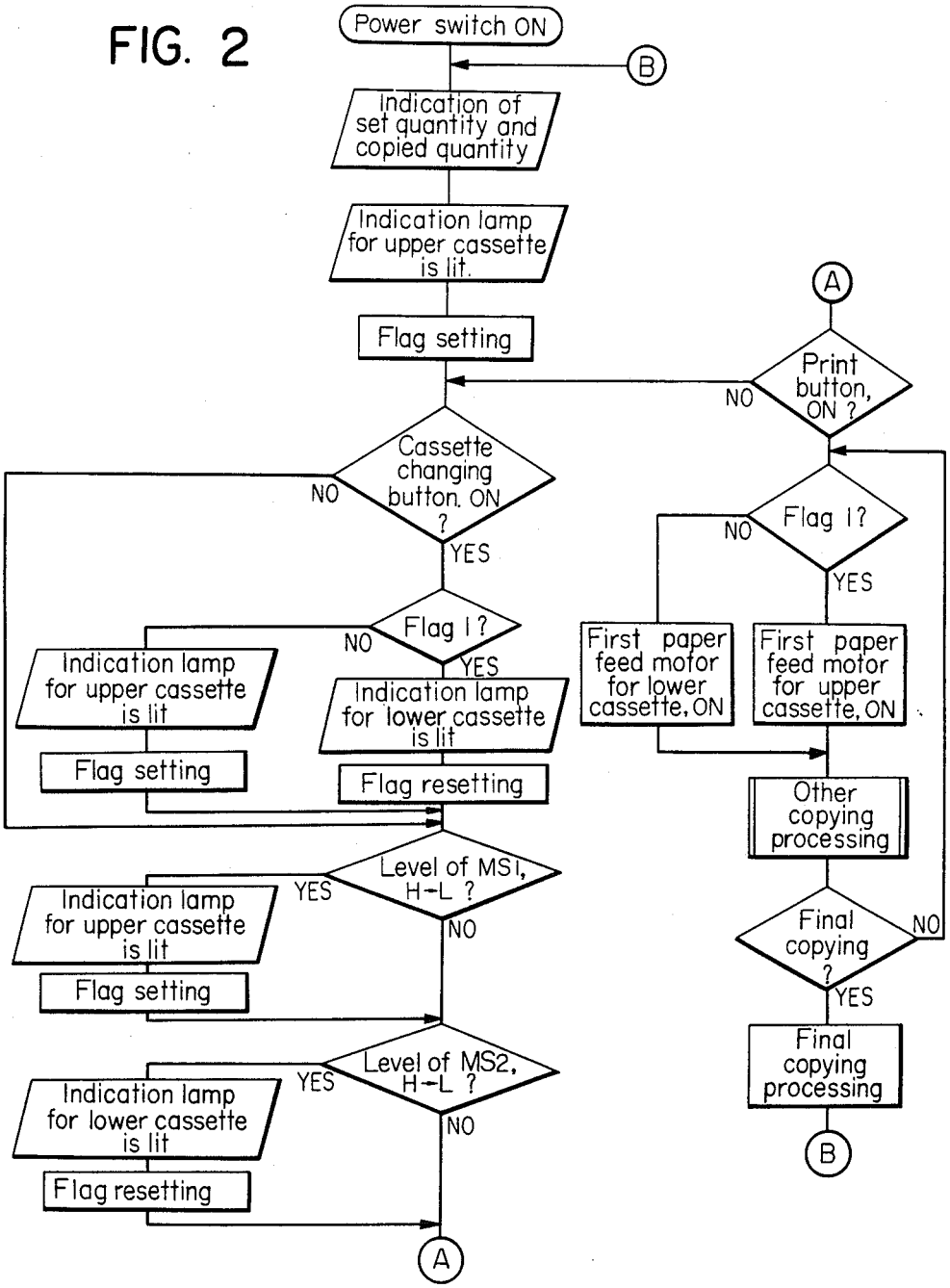
FIG. 2 is a flow chart that explains the movements of the controlling system of the present invention.

The controlling system for selection of recording sheet of the present invention will be explained next with the aid of a flow chart shown in FIG. 2, representing the steps performed in microcomputer 31.

When the power switch SW of the copying machine is turned on, the resetting circuit 32 is energized and the resetting signal is conveyed to the microcomputer 31, thus the operation of the program is started anew. Consequently, the set quantity is first indicated as 01 and the copied quantity is indicated as 00 on the counter 21 of the indication panel 20. This is because the program is prepared to take into consideration that most of the users of the copying machine make only one copy. Further in this example, since the priority is given to the upper cassette namely cassette 9, flag setting 1 to give the priority to the upper cassette is stored on the memory of the microcomputer 31 (this is expressed as "the flag is set") simultaneously with the lighting of the indication lamp 22 for the upper cassette. Next, whether or not the cassette changing button 25 has been pressed by the operator, namely, whether or not the cassette changing button 25 has been pressed to select the lower cassette 10 in case the recording sheets of desired size are not contained in the upper cassette 9 but contained in the lower cassette 10 is checked. In case it has been pressed, the flag setting to determne whether it is 1, is checked. The two decision steps of "Cassette changing button on?" and "Flag 1?" constitute a logic in which it is checked that the cassette changing button is pressed under the first condition wherein the flag is set at 1 or under the second condition wherein the flag is set at 0. When the button is pressed under the first condition, the indication lamp 23 for the lower cassette is lit, and the flag is reset at 0. Next, in case the recording sheets of desired size are not contained either in the upper cassette 9 or in the lower cassette 10, either one of the upper and lower cassettes is replaced with the cassette containing the recording sheets of desired size. For both cases of upper and lower cassettes replacing, the cassette is taken out once and the new cassette is inserted. Therefore, the same state as the one wherein all the recording sheets have been used up is generated, and consequently the output signal of the microswitch MS1 or MS2 is changed from the H (High) level (the state wherein a cassette which the recording paper is stored in is set in the machine) to the L (Low) level (the state wherein all the recording sheets have been used up or the state wherein the cassette has been removed). Returning to the flow chart, after these steps have been completed or, if the changing button is not pressed by the operator whether the output signal of the microswitch MS1 of the upper cassette 9 has been changed from the H level to the L level is checked. If it has been changed, the indication lamp 22 for the upper cassette is lit and the flag is set. If the output signal has not been changed, no action is taken. Next, the output signal level of the microswitch MS2 is checked. If the level has been changed from H to L, the indication lamp 23 for the lower cassette is lit and the flag is reset. If the output signal has not been changed, no action is taken.

Next, whether the print button 24 has been pressed is checked and, if it has been pressed, then whether the flag is set at 1 (i.e. whether the sheet feeding from the upper cassette or the sheet feeding from the lower cassette is desired) is desired is checked and in case of the former, electricity is supplied to the first sheet feeding roller 9*a* of the upper cassette 9 and in case of the latter, electricity is supplied to the first sheet feeding roller 10*a* of the lower cassette 10. Regardless of which cassette is actuated, a series of electrophotographic processes such as charging, exposure, developing, transferring, separation and fixing are made thereafter according to the print quantity set on the copying machine, and each recording operation is checked whether or not it is a final recording, and if it is on the half way of the set quantity and not a final recording for example, the same electrophotographic processes are repeated. When the recording operation is final after the final copying has been completed and a recording sheet therefor has passed the fixing device 14, the final recording processes such as the release of the pressing roller 14 of the heat roller type fixing device and the cutting of the power source of the high voltage electrode such as charging electrode and separation electrode are made. Thereafter, the succeeding recording operations are prepared.

In case the print button 24 is not pressed, whether or not the cassette changing button 25 has been pressed is checked, and if it has been pressed, whether or not flag is set at 1, i.e., whether the upper cassette 9 is selected or the lower cassette 10 is selected is checked. When the flag setting is 1, namely the upper cassette 9 is selected in the previous state, the lower cassette 10 is selected and the lower cassette indication lamp 23 is lit and flag is reset, because the cassette changing button 25 is pressed when the flag setting is 1. On the other hand, when the flag is not set at 1, namely the lower cassette 10 is selected in the previous state, the upper cassette 9 is selected and the upper cassette indication lamp 22 is lit and flag is set to 1, because the cassette changing button 25 is pressed when the flag setting is 0. Then it is checked that whether or not the cassette 9 or 10 is to be replaced as described above.

As explained above, the present invention enables the replaced or exchanged recording sheets to be fed without the operation for the selection of sheet size in the recording device wherein more than two types of recording sheets are loaded, and the recording sheets of desired size are used after the selection. For this purpose, in the above-mentioned example, the microswitch provided for the purpose of checking the existence of the recording sheets in the cassette is used to detect the replacing of cassettes, but instead of the microswitch, a magnetic sensor or photosensor can be used and in the recording device wherein no cassette is used, the recording sheet detecting sensor provided in the place where the recording sheets are loaded can be used. In the embodiment mentioned above, the description is made with relation to the case in which sheets having different size are used. But it is needless to say that the present invention can be applied to sheet having a difference thickness or the like as compared with one which has same size. In the present invention, since the recording sheets of desired kind can surely be fed only by the insertion thereof into the recording device, further selecting action of the kind of recording sheets is not necessary, which simplifies the recording operation and prevents completely that the recording is made on an undesired recording sheet and that the recording sheets are thus used without purpose.

What is claimed is:

1. An electrophotographic copying machine wherein recording paper is supplied to an image transfer mechanism from one of at least two cassettes comprising means for manually changing a selection of a first cassette from which paper is to be supplied, sensing means for detecting a replacement of a second cassette, and controlling means, responsive to signals from said sensing means, for effecting supply of paper to the image transfer mechanism from a replaced cassette irrespective of the prior selection of said first cassette by said manual selecting means.

2. The machine of claim 1 wherein said sensing means comprises a microswitch which generates signals responsive to removal of said second cassette and to insertion of said replaced cassette.

3. The machine of claim 2 wherein said controlling means is capable of detecting said replacement based on said signal generated responsive to said removal of said second cassette.

4. The machine of claim 2 wherein said microswitch is capable of detecting a state wherein no paper is stacked in said cassette.

5. An electrophotographic copying machine wherein recording paper is supplied to an image transfer mechanism from one of at least two cassettes comprising means for manually selecting one of said at least two cassettes from which paper is to be supplied, sensing means for detecting a replacement of a cassette, and controlling means, responsive to signals from said sensing means, for effecting supply of paper to the image transfer mechanism from the replaced cassette irrespective of the prior selection by said manual selecting means.

* * * * *